US006536975B1

(12) United States Patent
Tufts

(10) Patent No.: US 6,536,975 B1
(45) Date of Patent: Mar. 25, 2003

(54) LIQUID APPLICATOR WITH OPPOSED WINGS

(75) Inventor: Scott A. Tufts, Pittsburg, PA (US)

(73) Assignee: Mediflex Hospital Products, Inc., Overland Park, KS (US)

( * ) Notice: Subject to any disclaimer, the term of this patent is extended or adjusted under 35 U.S.C. 154(b) by 0 days.

(21) Appl. No.: 09/710,157

(22) Filed: Nov. 10, 2000

(51) Int. Cl.[7] ..... B43K 5/14

(52) U.S. Cl. ..... 401/134; 401/133; 604/3

(58) Field of Search ..... 401/134, 135, 401/133, 132; 222/81, 80, 87, 83, 85; 604/133, 3

(56) References Cited

U.S. PATENT DOCUMENTS

| | | | | |
|---|---|---|---|---|
| 1,313,566 | A | 8/1919 | Trowbridge | |
| 1,332,985 | A | 3/1920 | Jarrett | |
| 2,101,310 | A | 12/1937 | Callaghan | 132/1 |
| 2,377,837 | A | 6/1945 | Zimmerman | 15/125 |
| 2,642,065 | A | 6/1953 | Negri | 128/269 |
| 2,737,677 | A | 3/1956 | Pasulka | 15/133 |
| 2,975,464 | A | 3/1961 | Schultz | 15/563 |
| 2,976,560 | A | 3/1961 | Turner | 15/569 |
| 3,152,352 | A | 10/1964 | Kosik, Jr. | 15/539 |
| 3,153,401 | A | 10/1964 | Zepell | 120/48 |
| 3,366,112 | A | 1/1968 | Antonik | 128/268 |
| 3,369,543 | A | 2/1968 | Ronco | 128/269 |
| 3,466,131 | A | 9/1969 | Arcudi | 401/132 |
| 3,481,676 | A | 12/1969 | Schwartzman | 401/134 |
| 3,485,562 | A | 12/1969 | Hidden et al. | 401/134 |
| 3,757,782 | A | 9/1973 | Aiken | 128/269 |
| 3,759,259 | A | 9/1973 | Truhan | 128/269 |
| 3,768,916 | A | 10/1973 | Avery | 401/132 |
| 3,773,035 | A | 11/1973 | Aronoff et al. | |
| 3,774,609 | A | 11/1973 | Schwartzman | 128/269 |
| 3,786,820 | A | 1/1974 | Kopfer | 132/74.5 |
| 3,891,331 | A | 6/1975 | Avery | 401/132 |
| 4,027,985 | A | 6/1977 | Loesser, III | 401/134 |
| 4,053,243 | A | 10/1977 | Levin | 401/186 |
| 4,148,318 | A | 4/1979 | Meyer | 128/269 |
| 4,183,684 | A | 1/1980 | Avery, Jr. | 401/133 |
| 4,218,155 | A | 8/1980 | Weidner | 401/132 |
| 4,225,254 | A | 9/1980 | Holberg et al. | 401/119 |
| 4,229,116 | A | 10/1980 | Moore | 401/275 |
| 4,304,869 | A | 12/1981 | Dyke | 435/296 |
| 4,329,990 | A | 5/1982 | Sneider | 128/239 |
| 4,415,288 | A | 11/1983 | Gordon et al. | 401/132 |
| 4,475,835 | A | 10/1984 | Verboom et al. | 401/132 |
| 4,498,796 | A | 2/1985 | Gordon et al. | 401/132 |

(List continued on next page.)

FOREIGN PATENT DOCUMENTS

| | | | |
|---|---|---|---|
| CH | 186228 | * 11/1936 | 401/132 |
| EP | WO 84/03862 | * 10/1984 | 401/135 |
| GB | 16547 | 11/1915 | |

*Primary Examiner*—David J. Walczak
(74) *Attorney, Agent, or Firm*—Shook, Hardy & Bacon L.L.P.

(57) ABSTRACT

A liquid applicator for applying a desired liquid to a surface includes an elongated closed ampule formed of a frangible material containing the desired liquid; a flexible elongated hollow body having axially opposed open and closed ends and presenting a central longitudinal axis, the body defining an internal chamber which is adapted to receive the ampule; and a porous element sealed to the body and closing off the open end thereof so that liquid flows through the element when the ampule is fractured. The body includes a pair of diametrically opposed wings projecting therefrom which form gripping members that are spaced from the body and supported for pivoting movement relative thereto. The body also may include structure for fracturing the ampule, the structure being interposed between the body and the gripping members. Upon squeezing the gripping members toward one another, the structure flexes the body inwardly to exert a fracturing force against the ampule. The body also includes a flange protruding from the body at the open end thereof upon which the porous element is supported.

29 Claims, 2 Drawing Sheets

U.S. PATENT DOCUMENTS

| | | | | |
|---|---|---|---|---|
| 4,507,111 | A | 3/1985 | Gordon et al. | 604/3 |
| 4,572,689 | A | 2/1986 | Chernack | 401/132 |
| 4,588,319 | A | 5/1986 | Niemeyer | 401/205 |
| 4,594,015 | A | 6/1986 | Pomares | 401/266 |
| 4,784,506 | A | 11/1988 | Koreska et al. | 401/132 |
| 4,899,739 | A | 2/1990 | Konishi | 128/156 |
| 4,925,327 | A | 5/1990 | Wirt | 401/205 |
| 4,957,385 | A | 9/1990 | Weinstein | 401/132 |
| 5,147,337 | A | 9/1992 | Plone | 604/306 |
| 5,256,537 | A | 10/1993 | Phillips et al. | 435/7.1 |
| 5,299,877 | A | 4/1994 | Birden | 401/206 |
| 5,308,180 | A | 5/1994 | Pournoor et al. | 401/205 |
| 5,425,915 | A | 6/1995 | Phillips et al. | 422/58 |
| 5,445,462 | A | 8/1995 | Johnson et al. | 401/132 |
| 5,509,744 | A | 4/1996 | Frazier | 401/132 |
| 5,538,353 | A | 7/1996 | DeHavilland | 401/132 |
| 5,658,084 | A | 8/1997 | Wirt | 401/132 |
| D386,849 | S | 11/1997 | Dehavilland | D32/40 |
| 5,752,363 | A | 5/1998 | Edwards et al. | 53/410 |
| 5,772,346 | A | 6/1998 | Edwards | 401/132 |
| 5,782,801 | A | 7/1998 | Caillouette | 604/55 |
| D396,911 | S | 8/1998 | Dehavilland | D32/52 |
| 5,791,801 | A | 8/1998 | Miller | 401/132 |

* cited by examiner

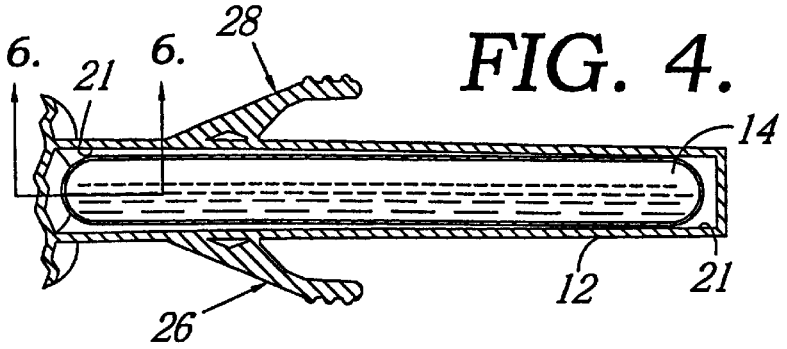
FIG. 4.
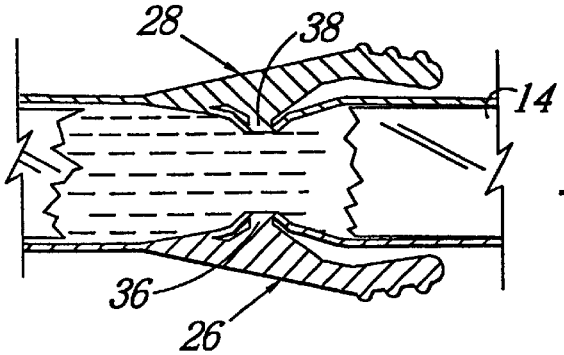
FIG. 5.
FIG. 6.
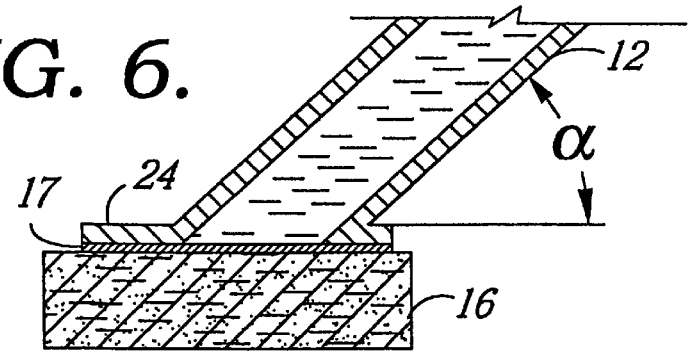
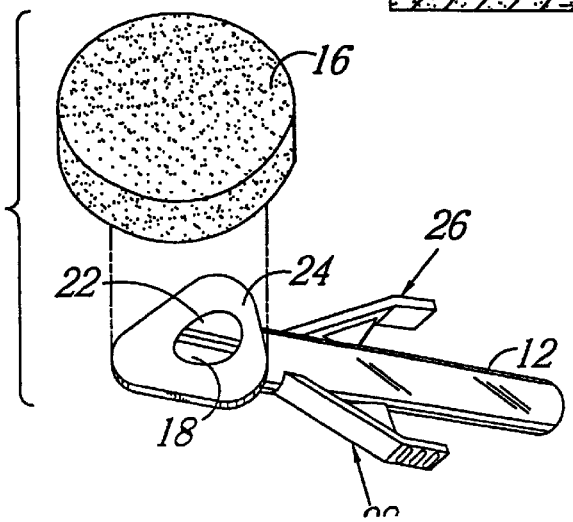
FIG. 7.

LIQUID APPLICATOR WITH OPPOSED WINGS

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

The present invention relates generally to liquid applicators. More specifically, the present invention relates to a hand-held liquid applicator having a flexible elongated hollow body within which a liquid-filled, glass ampule is received, and a mechanism for fracturing the ampule to release the liquid for dispensing.

Applicators for applying liquids such as medicaments or cleansing agents are known in the prior art. Conventional applicators typically provide a generally cylindrical body construction and include a glass ampule retained within the body; a sponge or tip secured to the body, at least one surface of which is exposed to the ampule; and a means for fracturing the ampule such that when the ampule is fractured, the liquid stored therein is dispensed to the sponge for application. In such applicators, the liquid-filled ampule is typically fractured by the user grasping the body wall and exerting a squeezing force directly thereon. Of course, the squeezing force necessary to fracture the ampule depends upon a number of factors such as the shape of the ampule, the material of which the body and ampule are formed, and the location at which the force is exerted.

Numerous problems are encountered with applicators of this type. For example, known applicators either include an unnecessarily large number of moving parts, which renders such devices expensive and complicated to construct as a disposable assembly, or require that a user employ both hands in breaking the ampule and dispensing the fluid.

In many situations, it is necessary for the user of a liquid dispenser of antiseptics or medicaments to use one hand to expose or position a portion of a patient's body which is to be treated with the liquid, while preparing the dispenser for use and applying the liquid with the other hand. For example, liquid applicators are often used to apply a pre-operative liquid, such as an isopropyl alcohol or iodine based solution, to an area of the body just prior to surgery. Thus, it is essential that the user be able to prepare and use the applicator with only one hand in order to enable the practical use thereof.

Another problem is that conventional applicators are often difficult to grasp and hold onto while exerting the squeezing pressure necessary to fracture the ampule or while applying the liquid to a surface. A further problem is that when the body wall is squeezed to fracture the ampule, nothing prevents the ampule from being pushed toward the open side of the hollow body after the ampule has been fractured. Accordingly, shards or pieces of the fractured ampule have a tendency to penetrate and poke into or through the sponge. In situations wherein the applicator is being used to apply a liquid to the skin of a patient, shards of glass protruding into or through the sponge obviously will be detrimental.

As such, there remains a need in the hand-held liquid applicator industry for a liquid applicator that is simple and inexpensive to construct relative to prior art applicators and which diminishes the risk of the user being injured by shards of the ampule penetrating the sponge or tip. Further, there is a need for a liquid applicator that has an improved gripping structure which provides the stability necessary to exert the squeezing pressure required and to apply the liquid to a surface.

SUMMARY OF THE INVENTION

Accordingly, in one of its aspects, the present invention provides an improved hand-held liquid applicator of quality construction having a body which may be squeezed to fracture the ampule enclosed therein, releasing the liquid contained in the ampule so that the liquid may be applied by the sponge.

In another of its aspects, the present invention provides an applicator which permits the user to squeeze the body at a location remote from the body wall which defines the internal chamber.

In still another of its aspects, the present invention provides one or more members for gripping the applicator which enhance handling of the applicator while permitting the aforementioned remote squeezing.

In yet another of its aspects, the present invention provides a disposable liquid applicator which permits single-handed operation in order to free the second hand of the user for use in assisting the application of liquid to a desired area.

In a still further aspect, the present invention provides a liquid applicator that is simple to construct and assemble and therefore may be manufactured more economically than prior art applicators.

In accordance with these and other aspects evident from the following description of a preferred embodiment of the invention, the liquid applicator for applying a desired liquid to a surface includes an elongated closed ampule, a flexible elongated hollow body which defines an internal chamber adapted to receive the ampule, and a porous element adapted to be used as an applicator for the liquid sealed to the body. The ampule is formed of a frangible material and contains a volume of liquid to be dispensed. The body presents axially opposed open and closed ends and includes a pair of diametrically opposed gripping members projecting therefrom which are suitable to be actuated by a user's fingers. The gripping members are spaced from the body at a distal end thereof The body also includes a flange protruding from the open end thereof upon which the porous element is supported. The porous element is sealed to the flange thus closing off the open end of the body. The body also may include structure for fracturing the ampule, the structure being interposed between the body and the gripping members. The hollow body further may include a plurality of inwardly projecting ridges positioned on the inner circumference thereof which act to support the ampule in the body and aid in securing the ampule in place upon fracture.

In use, the gripping members are squeezed toward one another causing the fracturing structure to exert a force against the ampule. The force causes fracturing of the ampule such that when the porous element is placed against the surface to which the liquid is to be applied, the liquid flows through the porous element and onto the surface. Fragments of the broken ampule are held in place by the inwardly projecting ridges, thus preventing shards of glass from poking or protruding through the porous element when the liquid is applied to the desired surface.

The present invention further provides a liquid applicator adapted to receive a fracturable ampule containing a volume of liquid to be applied, the applicator comprising a flexible elongated hollow body shaped for receiving the ampule, a pair of elongated gripping members diametrically projecting from the body, and a porous element adapted to be used as an applicator for the liquid. The body presents axially opposed open and closed ends as well as a flange protruding from the open end thereof to which the porous element is secured. The body also may include structure for fracturing the ampule, the structure being interposed between the body and the gripping members. The body further may include a plurality of inwardly projecting ridges positioned on the inner circumference thereof which support the ampule in the body and secure the ampule in place upon fracture.

In use, the gripping members are squeezed toward one another causing the fracturing structure to exert a force against the ampule. The force causes fracturing of the ampule such that when the porous element is placed against the surface to which the liquid is to be applied the liquid flows through the porous element and onto the surface. Fragments of the broken ampule are held in place by the inwardly projecting ridges, thus preventing shards of glass from protruding through the porous element when the liquid is applied to the desired surface.

The present invention further provides a method of applying a liquid with a liquid applicator, the method comprising the steps of providing a flexible hollow elongated body having axially opposed open and closed ends and shaped for receiving a frangible ampule containing a volume of liquid to be applied; coupling to the body a pair of elongated gripping members which project diametrically from the body and are suitable to be actuated by a user's fingers; and securing to the body a porous element which is positioned to close off the open end thereof. The method also may include the step of interposing a structure for fracturing the ampule between the body and the gripping members. Upon depression of the gripping members, the fracturing structure flexes the body inwardly to exert a fracturing force against the ampule. Thus, upon placement of the porous element against the surface to which liquid is to be applied, the liquid flows into the body and through the element.

By providing a liquid applicator in accordance with the present invention, numerous advantages are realized. For example, handling of the applicator is enhanced. Handling of the applicator is extremely important when it is employed as a cleansing agent dispenser in preparation for surgery wherein such use conditions are rigorous and slippery. Further, the risk of the user being injured by shards of a fractured ampule penetrating the porous element is diminished as the inwardly projecting ridges positioned onthe inner circumference of the body facilitate maintaining the ampule in position well below the open end of the body.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means, instrumentalities and combinations particularly pointed out in the appended claims.

BRIEF DESCRIPTION OF THE DRAWINGS

In the accompanying drawings which form a part of the specification and are to be read in conjunction therewith, and in which like reference numerals are employed to indicate like parts in the various views:

FIG. 4 is a fragmentary cross-sectional view taken generally along line 4—4 of FIG. 1, the liquid illustrated in dashed lines;

FIG. 5 is an enlarged fragmentary cross-sectional view of the liquid applicator as shown in FIG. 4 with the fracturing structures employed to fracture the glass ampule, the liquid illustrated in dashed lines;

FIG. 6. is a cross-sectional view taken along line 6—6 of FIG. 4 illustrating the porous element and laminate material after the ampule has been fractured and liquid is allowed to flow toward the porous element; and FIG. 7 is an exploded bottom perspective view of the liquid applicator of FIG. 1 illustrating the placing of the porous element on the flange of the body.

DETAILED DESCRIPTION OF THE PREFERRED EMBODIMENT

Figure 1:
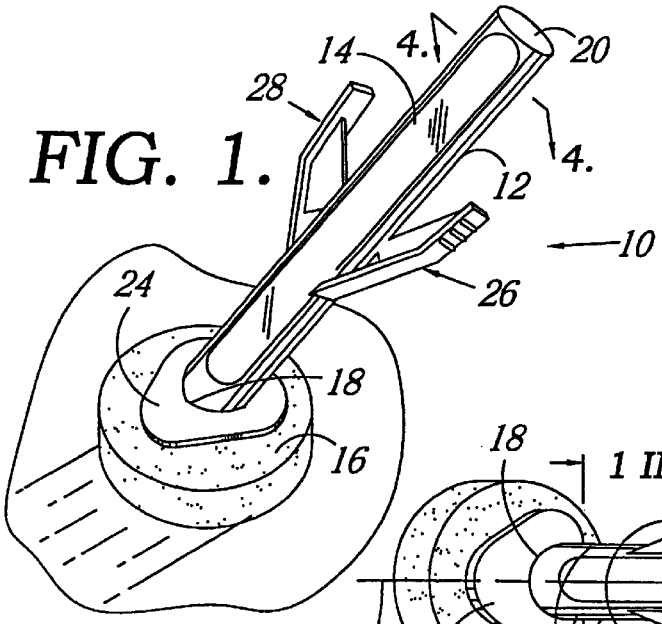
FIG. 1 is a perspective view of a liquid applicator constructed in accordance with a preferred embodiment of the invention.

Referring to the drawings in general and initially to FIG. 1 in particular, where like reference numerals identify like elements in the various views, a liquid applicator manifesting aspects of the invention is illustrated and designated generally by the numeral 10. The liquid applicator 10 generally includes a body 12, a closed ampule for containing liquid 14 received in the body 12, and a porous element 16 secured to the body 12.

The ampule 14 can be used for containing various liquids such as medicaments, cleansing agents, cosmetics, polishes or the like. In the illustrated embodiment, the ampule 14 contains an antiseptic solution to be applied to a patient's skin prior to surgery. The ampule 14 is illustrated as an elongated cylinder which defines a central longitudinal axis. However, it will be appreciated that the principles of the present invention also may be applied to spherical or elongated polygonal ampules. Preferably, the ampule 14 is formed of glass, although other materials are entirely within the scope of the present invention. The wall of the glass ampule 14 is of a thickness sufficient to contain the desired liquid during transport and storage, yet allow the ampule to be fractured upon the application of localized pressure.

Figure 2:
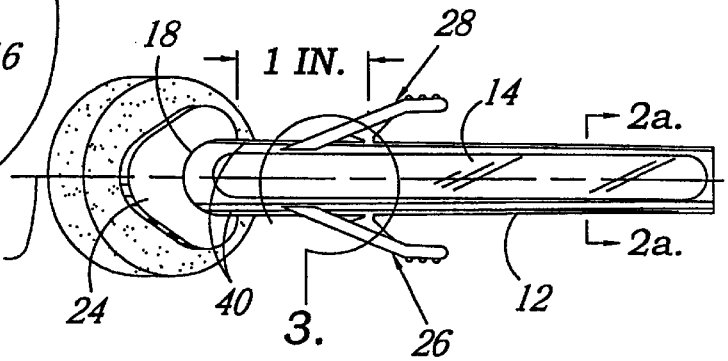
FIG. 2 is a top plan view constructed in accordance with a preferred embodiment of the invention.
Figure 2A:
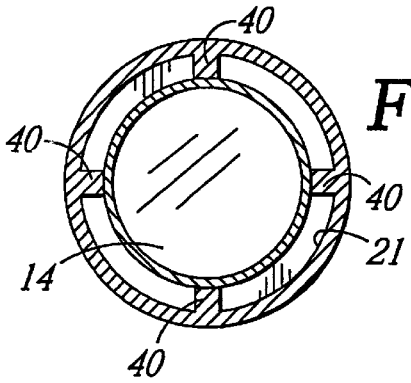
FIG. 2*a* is a cross-sectional view taken generally along line 2*a*—2*a* of FIG. 2.

As shown in FIGS. 1, 2 and 7, the body 12 is of a generally hollow cylindrical shape and includes axially opposed first and second ends 18,20. The proximal first end 18 is open and the distal second end 20 is closed. The preferred body 12 is formed of high density polyethylene, although any material exhibiting similar flexibility and integrity may be used. In the preferred embodiment, the second end 20 is closed during the molding process obviating the need for a cap or the like. The preferred body 12 is elongated and defines a central longitudinal axis which is collinear with the central longitudinal axis of the ampule 14. Preferably, the thickness of the wall is between 0.05 and 0.15 inches. More preferably, the thickness of the wall is approximately 0.115 inches.

The body 12 includes an interior wall 21 which defines an internal chamber 22 within body 12. Interior wall 21 is shaped to conform generally with the shape of the ampule 14 which is received within the internal chamber 22. The circumference of the interior wall 21 is slightly larger than the outer surface of the ampule body such that a plurality of inwardly projecting ridges 40 positioned on the interior wall 21 of the hollow body 12 support the ampule 14 therein. Preferably, the interior wall 21 includes four inwardly projecting ridges 40 which are offset from one another by approximately 90° around the interior wall 21 of body 12. The ridges 40 engage the periphery of the ampule to maintain the ampule 14 within the internal chamber 22 and prevent untoward 20 movement of shards of the ampule through the porous element 16 when fracturing of the ampule is effected, as more fully described below.

The body 12 further presents a flange 24 protruding from the open end 18 along the periphery thereof. In the preferred embodiment, the flange 24 is continuously molded to the body 12 and is disposed at an angle, a, such as 45°, with respect to the central longitudinal axis of the body. The flange 24 is adapted to support the porous element 16, as more fully described below.

Figure 3:
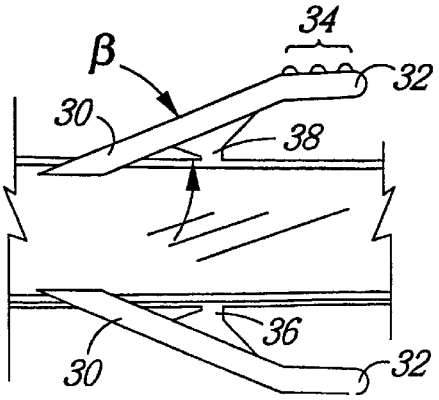
FIG. 3 is an enlarged fragmentary view of the area enclosed by line 3 in FIG. 2.

With reference to FIG. 3, the body 12 also includes a pair of elongated gripping members 26,28 which are diametrically opposed and project from the body. Each gripping member 26, 28 includes an attachment portion 30 outwardly extending from the body 12 and a handling portion 32 extending from the distal end of the attachment portion 30. Preferably, the attachment portion 30 of each gripping member 26, 28 extends outwardly from body 12 at an angle, β, of between 36.5° and 37.5°. More preferably, attachment portion 30 extends from body 12 at approximately 36.8°.

The handling portion 32 is spaced from the body 12 and is positioned generally parallel to the central longitudinal axes of both the body and the ampule 14. As illustrated in FIGS. 1–3, each handling portion 32 is positioned substantially in a plane defined by the central longitudinal axis, "x", of the body 12. Preferably, the handling portion 32 is spaced between 0.30 and 0.35 inches from the body 12. More preferably, the handling portion 32 is spaced approximately 0.325 inches from the body 12. The handling portion 32 of each gripping member 26,28 includes a textured outer surface 34 to facilitate handling of the applicator 10 and to inhibit slippage from the user's hand during application.

In the preferred embodiment, gripping members 26,28 are continuously molded with body 12. It will be understood and appreciated, however, that separately formed gripping members are contemplated to be within the scope of the present invention.

As shown in FIG. 3, body 12 also includes structure for fracturing the ampule 14. Preferably, the structure includes breaking tabs or tappets 36, 38 interposed between the gripping members 26, 28 and the body 12. It will be appreciated, however, that the principles of the present invention are equally applicable to various other structure for fracturing the ampule 14, such as multiple breaking tabs and one or more retaining tabs. The textured outer surface 34 of the gripping members 26, 28 present a gripping area which is significantly larger than the area of the tabs 36, 38. Upon depression of the gripping members 26, 28, the breaking tabs 36, 38 flex the body 12 inwardly, thereby localizing the forces effected by squeezing the members 26, 28 toward one another and enhancing fracturing of the ampule 14 as more fully described below.

In the preferred embodiment, the liquid applicator 10 of the present invention is constructed to house a 3 ml ampule. It will be understood and appreciated, however, that ampules of various sizes may be utilized and such is contemplated to be within the scope of the present invention. In the 3 ml embodiment, the distance between the lateral line defined by the most downwardly positioned portion of flange 24, and the fracturing structure is approximately 1.0 inches. It will be understood and appreciated, however, that this distance will vary based upon the size of the applicator and ampule utilized. Any such variation is contemplated to employ a similar angular orientation for the gripping members, however. Such variations are contemplated to be within the scope of the present invention.

A porous element 16 such as a sponge or the like closes off the open end 18 of the body 12. The porous element 16 is received on flange 24 and encloses the ampule 14 within the internal chamber 22. With reference to FIG. 6, the porous element 16 is formed of felt or an open-celled foam material that is laminated on one side with laminate material 17. In the preferred embodiment, laminate material 17 is a woven or non-woven polyester material or fabric such as polyethylene. Laminate material 17 of the porous element 16 is positioned between the open-celled foam material and the flange 24 of the body 12. As such, laminate material 17 functions to prevent shards of glass from the fractured ampule from pushing through the porous element during use of the applicator. In addition, the polyethylene coating provides material at the interface between the flanges 24 of the body 12 and the porous element 16, and is partially melted during formation of the applicator, as more fully described below.

The preferred porous element 16 is cut from a sheet of sponge material having the desired porosity for the liquid to be dispensed, whereby liquid is prevented from flowing immediately through the element 16 when the ampule 14 is fractured. In other words, once an ampule 14 is fractured, the released liquid saturates the element 16 and flows from the element 16 only as the surface absorbs the liquid from the saturated element 16. Consequently, the body 12 essentially functions as a reservoir of the desired liquid. The porous element 16 is preferably generally circular in shape although it will be appreciated that the element may be of any desired size and shape which is capable of being supported on the flange 24.

During formation of the applicator, the ampule 14 is inserted into the internal chamber 22 of the body 12. Thereafter, the porous element 16 is secured to the body 12 of the applicator by welding the laminate material to the flange 24 using an ultrasonic welding operation. The polyester material of the laminate provides suitable welding material that melts together with the material of the flange 24 to secure the porous element 16 in place over the internal chamber 22 and enclose the ampule. 14. Securing the porous element 16 on the flange 24 in this manner facilitates preventing leakage between the flange 24 and the element 16. It will be appreciated that other suitable securing expedients could be employed in place of the ultrasonic welding operation. For example, the porous element 16 could be secured in place by an adhesive or stitching, or by heat sealing or chemically bonding the element in place. Such alternative securing expedients are contemplated to be within the scope of the present invention.

The porous element 16 is disposed at an angle, α, such as 45°, with respect to the central longitudinal axis of the body 12. Thus, the liquid may be released to flow by gravity upon fracture of the ampule 14 to the porous element 16 affixed to the open end 18 of the body 12. When the applicator is manipulated for scrubbing with the closed, distal end oriented away from the surface to be scrubbed and the porous element oriented toward the surface, the liquid will flow from the fractured ampule under the force of gravity down the body 12 to the open end 18 and through the porous element 16.

By employing a porous element having a laminate as described herein, numerous advantages are realized. For example, the material presents a physical barrier that resists puncture by glass fragments of the fractured ampule. In addition, the laminate material provides a suitable welding material for securing the porous element in place on the body when an ultrasonic welding operation is used to manufacture the applicator. Further, by providing a relatively simple construction in which the body and porous element are welded together and the gripping members and porous element are disposed as described herein, an applicator is obtained which may be designed for single use, and which enables one-handed operation.

In use, the applicator 10 presents a hand-held liquid applicator that is squeezed to release the desired liquid contained therein for application to a surface. The applicator 10 is designed to be grasped by the user so that the gripping members 26, 28 are held between the thumb or palm and fingers of one hand of the user, thus allowing for single-handed operation. The ampule 14 is fractured by the user squeezing the gripping members 26, 28 toward one another. The movement of the members 26,28 is transferred by the tabs 36,38 to the body 12 to deform the body 12 inwardly and exert discrete localized fracturing forces against the ampule 14. The gripping members provide a lever action that gains mechanical advantage as the members are squeezed toward one another. Accordingly, if the user has limited gripping strength, or if the wall of the ampule is exceptionally thick, the members ensure fracturing of the ampule.

As shown in FIG. 5, once the members 26, 28 have been sufficiently squeezed together, the resulting forces fracture the ampule 14 releasing the liquid contained therein. Once the ampule 14 is fractured, liquid flows from the ampule 14 to the body 12, as best seen in FIG. 6. If the applicator 10 is held in an orientation relative to the desired surface as shown in FIG. 1, the liquid flows to the proximal end and is absorbed by the porous element 16. Thereafter, application of the liquid is accomplished by bringing the porous element 16 into contact with the desired surface. The user may then use a painting or scrubbing motion to apply the liquid to the surface. The entire process of fracturing the ampule 14 and applying the liquid to a desired surface is achieved with the use of only one hand of the user.

Constructed and operated as previously described, this invention provides a hand-held liquid applicator of quality construction having a body which may be squeezed from a location remote from the body to fracture an ampule of liquid contained within the body. Further, this invention provides a disposable liquid applicator which permits single-handed operation in order to free the second hand of the user for use in assisting application of the liquid to the desired area. The liquid applicator of the present invention also is simple to construct and assemble and, therefore, may be manufactured more economically than prior art applications.

From the foregoing, it will be seen that this invention is one well adapted to attain all the ends and objects hereinabove set forth together with other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A liquid applicator for applying a desired liquid to a surface, the applicator comprising:

an elongated ampule formed of a frangible material and adapted to contain the liquid;

an elongated hollow body presenting a longitudinal axis having axially opposed open and closed ends, said body defining an internal chamber adapted to permanently receive said ampule;

a pair of elongated gripping members projecting from said body, wherein each said gripping member is substantially positioned in a plane, said plane defined by the longitudinal axis of said body, said gripping members flexing said body inwardly to fracture said ampule when said members are squeezed toward one another; and a porous element secured to said body and closing off said open end thereof, such that liquid flows through said element when said ampule is fractured.

2. The liquid applicator as recited in claim 1, wherein said body and said gripping members are integrally formed.

3. The liquid applicator as recited in claim 1, said body further including a flange protruding from said open end thereof, wherein said porous element is secured to said flange.

4. The liquid applicator as recited in claim 3, wherein said porous element is laminated with a laminate material, said laminate material being secured directly to said flange of said body for resisting puncture by fragments of said ampule upon fracture thereof.

5. The liquid applicator as recited in claim 4, wherein said laminate material is a woven or non-woven fabric.

6. The liquid applicator as recited in claim 5, wherein said laminate material is a woven or non-woven polyester fabric.

7. The liquid applicator as recited in claim 4, wherein the laminate material and said flange of said body are melted together to secure said porous element to said body.

8. The liquid applicator as recited in claim 1, further comprising a structure for fracturing said ampule, said structure interposed between said body and said gripping members, wherein said structure flexes said body inwardly to exert a fracturing force against said ampule when said gripping members are squeezed toward one another.

9. The liquid applicator as recited in claim 8, wherein said structure for fracturing said ampule is integrally formed with said body and said gripping members.

10. The liquid applicator as recited in claim 8, wherein said structure for fracturing said ampule includes first and second diametrically opposed tappets, said tappets positioned between said body and respective ones of said gripping members.

11. The liquid applicator as recited in claim 1, wherein said ampule is formed of glass.

12. The liquid applicator as recited in claim 1, wherein the hollow body further includes an inner circumference having a plurality of inwardly projecting ridges thereon for maintaining said ampule in position relative to said open end of said body.

13. The liquid applicator as recited in claim 1, wherein each said gripping member includes an attachment portion and a handling portion, and wherein said handling portion is spatially removed from said body.

14. The liquid applicator as recited in claim 13, wherein each said handling portion is substantially parallel to said central longitudinal axis of said body.

15. The liquid application as recited in claim 14, wherein each said handling portion is positioned in a plane, said plane defined by the central longitudiual axis of said body.

16. The liquid applicator as recited in claim 15, said handling portion including a textured surface for facilitating handling of the applicator.

17. A liquid applicator adapted to receive a fracturable ampule containing a liquid to be applied, the applicator comprising:

an elongated hollow body shaped for permanently receiving the ampule, said body presenting a longitudinal axis having axially opposed open and closed ends;

a pair of elongated gripping members projecting from said body, wherein each said gripping member is substantially positioned in a plane, said plane defined by the longitudinal axis of said body, said gripping members flexing said body inwardly to fracture said ampule when said members are squeezed toward one another; and a porous element secured to said body and closing off said open end thereof, such that liquid flows into said body and through said element when the ampule is fractured.

18. The liquid applicator as recited in claim 17, said body further including a flange protruding from said open end of said body, wherein said porous element is secured thereto.

19. The liquid applicator as recited in claim 18, wherein said porous element is laminated with a laminate material, said laminate material being secured directly to said flange of said body for resisting puncture by fragments of the ampule upon fracture.

20. The liquid applicator as recited in claim 19, wherein said laminate material and said flange of said body are melted together to secure said porous element to said body.

21. The liquid applicator as recited in claim 17, further comprising a structure for fracturing said ampule, said structure interposed between said body and said gripping members, wherein said structure flexes said body inwardly to exert a fracturing force e against said ampule when said gripping members are squeezed toward one another.

22. The liquid applicator as recited in claim 21, wherein said structure for fracturing said ampule includes first and second diametrically opposed tappets, said tappets positioned between said body and respective ones of said gripping members.

23. The liquid applicator as recited in claim 17, wherein said hollow body further includes an inner circumference having a plurality of inwardly projecting ridges thereon for maintaining the ampule in position relative to said open end of said body.

24. The liquid applicator as recited in claim 17, wherein each said gripping member includes an attachment portion and a handling portion, and wherein said handling portion is spatially removed from said body.

25. The liquid applicator as recited in claim 24, wherein each said handling portion is substantially parallel to said central longitudinal axis of said body.

26. The liquid applicator as recited in claim 25, wherein each said handling portion is positioned in a plane, said plane defined by said central longitudinal axis of said body.

27. The liquid applicator as recited in claim 26, said handling portion including a textured surface for facilitating handling of the applicator.

28. A method of making a liquid applicator, the applicator shaped for receiving a frangible ampule containing a liquid to be applied, the method comprising the steps of:

providing a flexible hollow elongated body presenting a longitudinal axis having axially opposed open and closed ends and being adapted to permanently receive the ampule;

coupling to said body a pair of elongated, wing-like gripping members, said gripping members projecting from said body, wherein each said gripping member is substantially positioned in a plane, said plane defined by the longitudinal axis of said body, wherein said gripping members flex said body inwardly to exert a fracturing force against the ampule when said members are squeezed toward one another; and to said body a porous element, said element positioned to close off said open end of said body, such that liquid flows into said body and through said element when the ampule is fractured.

29. The method of making a liquid applicator as recited in claim 28, further comprising the step of interposing a structure for fracturing the ampule between said body and said gripping members such that said structure flexes said body inwardly to exert a fracturing force against the ampule when said gripping members are squeezed toward one another.

* * * * *